United States Patent [19]

Wilkinson

[11] 4,163,431

[45] Aug. 7, 1979

[54] ZERO-HYSTERESIS ENGINE RPM LIMITER

[75] Inventor: Richard L. Wilkinson, Torrance, Calif.

[73] Assignee: Race Research, Inc., Carson, Calif.

[21] Appl. No.: 759,740

[22] Filed: Jan. 17, 1977

[51] Int. Cl.[2] ..... F02P 9/00

[52] U.S. Cl. ..... 123/118

[58] Field of Search ..... 123/118, 102, 148 F, 123/198 DC

[56] References Cited

U.S. PATENT DOCUMENTS

| | | | |
|---|---|---|---|
| 3,665,903 | 5/1972 | Harris et al. | 123/118 |
| 3,884,203 | 5/1975 | Cliffgard | 123/118 |
| 4,010,726 | 3/1977 | Kondo et al. | 123/102 |

*Primary Examiner*—Charles T. Jordan

*Attorney, Agent, or Firm*—Fulwider, Patton, Rieber, Lee & Utecht

[57] ABSTRACT

Apparatus for limiting the rotational speed of an internal combustion engine by monitoring the time interval between ignition impulses produced when a breaker switch in the primary circuit of the ignition coil opens. A pair of sequentially operable timers are started for each ignition pulse with the second time interval enabling a delay means coupled between the source of pulses and a control gate of a controlled switch connected across the breaker switch through an impedance. When a following pulse occurs during the second time interval, indicating a limiting rotational speed, the slightly delayed pulse triggers the controlled switch and the ignition pulse is shunted through the impedance with the resulting secondary voltage in the ignition coil being insufficient to cause a spark, thereby limiting the speed of the engine.

2 Claims, 6 Drawing Figures

ZERO-HYSTERESIS ENGINE RPM LIMITER

BACKGROUND OF THE INVENTION

1. Field of the Invention

The present invention relates generally to engine rpm limiters and, more particularly, to such a limiter which exhibits zero-hysteresis characteristics in that there is substantially no rpm difference between limiting and restarting speeds.

2. Description of the Prior Art

Prior art rpm limiters for internal combustion engines have ranged from mechanical governors to electrical circuitry which usually acts upon the ignition system to prevent the spark plugs from firing and thus lower the engine speed. While some systems act as a simple switch which merely turns off the complete ignition system when an rpm limit is reached and turns it back on when a lower rpm limit is sensed, this produces an rpm difference between the limiting rpm and the restarting rpm, herein defined as hysteresis.

Other, faster operating systems, monitor the time interval between ignition pulses produced when the cam operated breaker switch in the primary of the ignition coil opens and, when the time interval decreases to a predetermined limit, indicative of a limiting rpm, the breaker switch is shorted preventing the generation of the following ignition pulses and, consequently, a spark. Some prior art techniques track or monitor the rpm of the engine by using analog type signal generators which are relatively slow in responding. Thus, when an rpm limit is reached, the breaker switch is usually shorted for a number of ignition pulse times before the rpm signal can again be monitored by means of the ignition pulses. Prior art systems utilizing this technique are illustrated by the patents to Harris, U.S. Pat. No. 3,665,903, Roth, U.S. Pat. No. 3,858,563, and Anderson, U.S. Pat. No. 3,875,915.

Other prior art systems have utilized digital timing techniques for monitoring the time interval between ignition pulses. Such systems are illustrated by the patent to Olson, U.S. Pat. No. 3,738,340. However, when the rpm limit is reached, the breaker switch is again shorted and the following ignition pulse cannot be used for timing. Again, there is a time interval or rpm difference between the limit and restart engine speeds with the result that the engine can cycle between the limit and restart speeds.

Prior art systems which have attempted to preserve the ignition pulses for timing purposes but inhibit the generation of a spark are illustrated by the patents to Kondo, U.S. Pat. No. 3,967,604 and Howard, U.S. Pat. No. 3,704,699. In both cases, the inhibition of the spark is effected by relatively complicated auxiliary circuitry which is a part of the ignition system itself and cannot be simply connected to an existing system.

Therefore, there has long been a need for an rpm limiting system which could monitor the rotational speed of an engine for a predetermined upper limit which would not exhibit the hysteresis effect, and which could be simply attached to an existing ignition system without further modifications. The present invention satisfies that need.

SUMMARY OF THE INVENTION

The present invention provides an rpm limiting system which does not exhibit the hysteresis effect. Limiting is effected by monitoring the time interval between ignition pulses and, if a following ignition pulse falls within a predetermined time window, the wave shape of the ignition pulse is changed so that a spark cannot be generated at that time. However, the modified ignition pulse is still utilized as a starting pulse for the monitoring timing circuits so that, if the next following pulse is outside of the window, a spark will be generated. Thus, the rpm limiting system of the invention effectively monitors every time interval between ignition pulses and inhibits only those which represent an exceeding of the upper rpm limit.

The use of bidirectional controlled switches and a novel pulse coupling circuit permits the use of the system of the invention with either positive or negative going ignition pulses, making the completed commercial packaged system applicable to any of the generally used ignition systems which utilize the conventional cam operated breaker switch in the primary of an ignition coil.

To effect the change in the waveform of the ignition pulse before a spark can be generated in the secondary of the ignition coil, use is made of the threshold characteristics of bidirectional controlled semiconductor switches which permit the initial voltage rise of the ignition pulse but which react substantially instantaneously when the threshold is reached. Thus, the ignition pulse to be inhibited is initially sensed in order to start the interval timers of the system but the time delay involved is insignificantly small when compared with the time duration of the ignition pulse so that voltage buildup in the secondary of the ignition coil is insufficient to result in a spark.

In the system of the invention, a two-stage timer is used to monitor the time interval between ignition pulses. This results in two advantageous results, one of which is that the first timer is initiated by the ignition pulse and its duration provides a length of time during which no sensing operation is performed. During this time, the breaker switch is open and numerous spurious voltages may occur which are prevented from affecting the monitoring operation. Following the first time interval, a second timer is started which provides a sensing enabling signal over a predetermined time window. If the next ignition pulse should occur within that time window, it is an indication that the rpm limit is met or exceeded and the inhibiting circuitry is activated.

Thus, the rotational speed limiting system of the present invention provides a zero-hysteresis limitation in a relatively uncomplicated digital circuit technique which may be connected directly across the breaker switch of an existing ignition system regardless of the polarity of the generated ignition pulses. The circuitry includes bidirectional controlled switches and a two-stage timing system to eliminate spurious responses of the controlled switches and to provide a timed limiting window with any ignition pulse appearing in that window being shunted through an impedance to change its waveform and inhibit the generation of a spark.

DESCRIPTION OF THE PREFERRED EMBODIMENT

Figure 1:
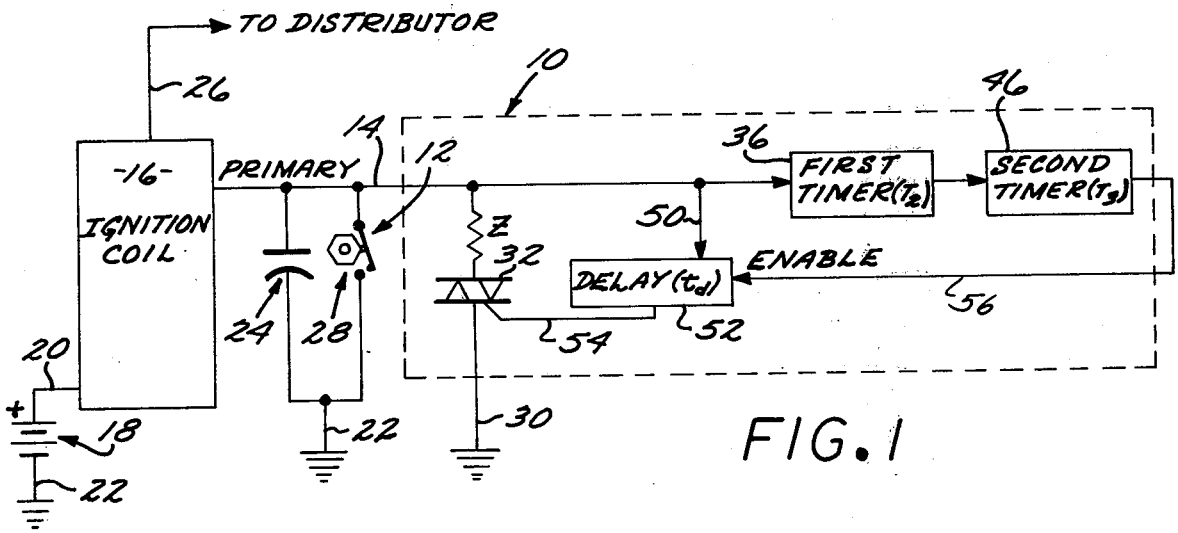
FIG. 1 is a block and schematic diagram of the rotational speed limiting system of the invention connected across the breaker switch of a conventional ignition system.

Turning now to the drawings, particularly FIG. 1 thereof, an rpm limiter 10 constructed in accordance with the present invention is connected across a cam operated breaker switch 12 of a conventional ignition system on a line 14. As is well known, conventional ignition systems include an ignition coil 16 with a primary winding and a high voltage secondary winding, both supplied with DC power from a battery 18 connected to the coil 16 through line 20. A line 14 from the primary of the ignition coil is connected through the breaker switch 12 to a ground connection 22. Typically, an arc suppressing capacitor 24 is connected across the switch 12.

A secondary output line 26 is connected to the distributor, as is well known, for distribution of high voltage pulses to the spark plugs. In operation, a cam 28 rotates in synchronism with the crankshaft of the engine and opens and closes switch 12 periodically. When the switch 12 is closed, a current flows in the primary winding of the ignition coil 16 and when the cam 28 opens switch 12, the magnetic field in the primary collapses and generates an ignition pulse which appears across the open terminals of the breaker switch 12. The ignition pulse generates a high voltage pulse in the secondary winding which is fed to the distributor through line 26.

In the rpm limiting system of the present invention, the speed of rotation of the engine is limited by inhibiting the generation of a spark on one or more successive cylinders causing the engine speed to decrease. Spark inhibition in the present system is effected by connecting the rpm limiter 10 across the breaker switch 12 from line 14, through the limiter 10 to a ground connection 30. The spark is inhibited by connecting the ignition pulse which appears on the primary winding line 14 through an impedance Z and a controlled switch 32 to the ground connection 30. This essentially connects the primary winding of the ignition coil 16 in a series circuit with the impedance Z creating a discharge waveform which does not result in the generation of a high voltage pulse in the secondary of the coil.

Figure 2A:
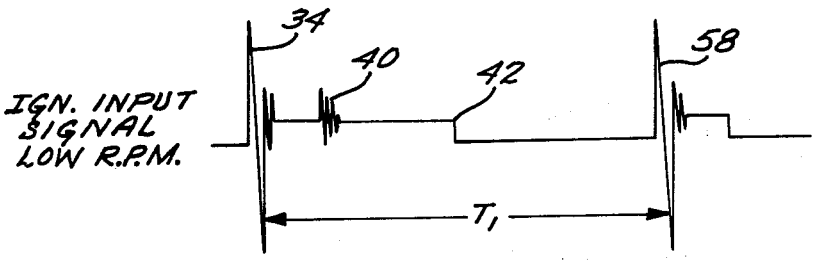
FIGS. 2A–2D are signal diagrams of ignition pulses and timer outputs for the system shown in FIG. 1 illustrating the effect of an ignition pulse occurring within the limiting time window.
Figure 2B:
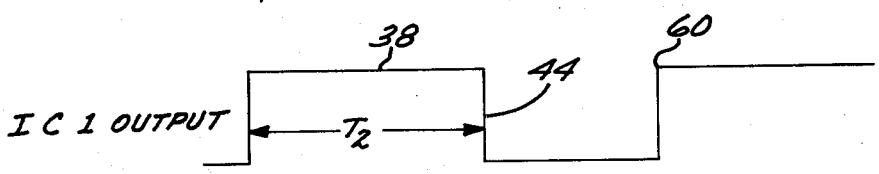

Whether the ignition pulse occurring on the primary line 14 will be modified is dependent upon the time interval between successive pulses, as will be illustrated with reference to FIGS. 2A–2D. Referring to FIG. 2A, a first ignition pulse 34 occurs on line 14 and is applied as a triggering input to a first timer 36 in the rpm limiter 10 producing a fixed predetermined time period T2 illustrated by graph 38 in FIG. 2B. During the time period T2, the breaker switch is opened and spurious voltages such as the end of spark pulse 40 (FIG. 2A) may occur so the sensing circuits of the limiter 10 are essentially disabled during that time. When the breaker switch 12 again closes, as illustrated at 42 (FIG. 2A), the input to the limiter 10 is quiescent and sensing can begin.

Figure 2C:
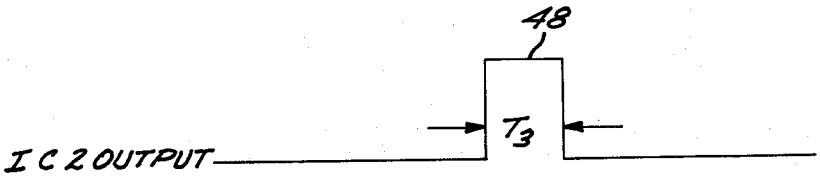

At some predetermined time period T2 after the breaker switch 12 has closed, the first timer 36 returns to its off condition and produces a negative going transition 44 which is the arbitrarily defined necessary signal for triggering a second timer 46 which then produces an output window 48 as shown in FIG. 2C. The output window time period T3 together with the first time period T2 define a limiting time period between ignition pulses (T1) in FIG. 2A. The time period T3 need only be long enough to insure that a pulse occurring at less than the predetermined minimum time will be caught within the time window. Thus, it can be seen that the first timer 36 provides a time period T2 which in essence sets the limiting time representative of a limiting rotational speed and the window time T3 insures that a limiting ignition pulse is captured.

The use of the window time signal 48 is shown in FIG. 1. Normally, the controlled switch 32 is an open circuit and the ignition pulses may occur on line 14 uninhibited. The ignition pulses on line 14 are also connected through a line 50 to a delay circuit 52 to be described below, which generates a gating signal on line 54 a predetermined time period $t_d$ after the ignition pulse appears on line 50 only if the delay circuit 52 is enabled via a line 56 from the second timer 46. The enable signal on line 56 is the window signal 48 shown in FIG. 2C. Thus, the delay circuit 52 is enabled only during the window time. It should be appreciated that utilizing this circuit provides that the ignition pulse provides its own gating signal for the controlled switch 32 following a relatively short time delay $t_d$ which permits the triggering of the first timer 36. Following the initial delay $t_d$, controlled switch 32 conducts and the impedance Z is placed in the primary circuit changing the waveform of the pulse.

This effect is illustrated by FIG. 2. In FIG. 2A, a first ignition pulse 34 triggers the first timer producing the output signal 38 for a duration of time period T2. The trailing edge 44 of the first timer signal 38 starts the second timer 46 to produce the window signal 48 for a period of time T3. If, as shown in FIG. 2, a second ignition pulse 58 occurs after the total time period T2 and T3, it will normally be utilized to generate a spark and also to retrigger the first timer 36 as shown at 60 in FIG. 2B.

Figure 2D:
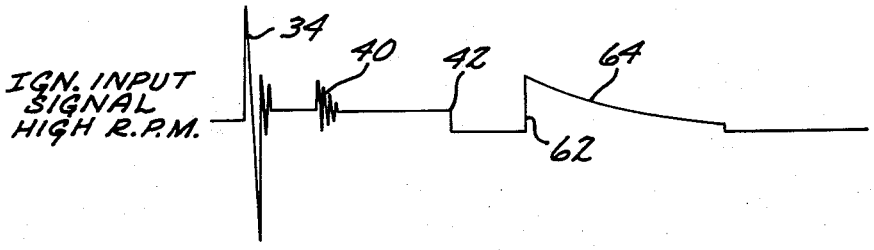

If, however, the ignition pulse timing is as shown in FIG. 2D, when the time T2 is expired and the window signal 48 is in effect, enabling the delay circuit 52 (FIG. 1), the new second ignition signal 62 occurs within the limiting window. Thus, the second ignition pulse 62 begins to rise over the delay time period $t_d$ but reaches only a predetermined amplitude before the controlled switch 32 is triggered, connecting the impedance Z in series with a primary winding. The result is a discharge of the energy in the primary coil in a substantially exponential manner as shown at 64 in FIG. 2D. The initial rise of the second ignition pulse at 62 is sufficient to initiate triggering of the first timer 36 which can function independently of the fact that the window signal 48 may still be in effect.

Figure 3:
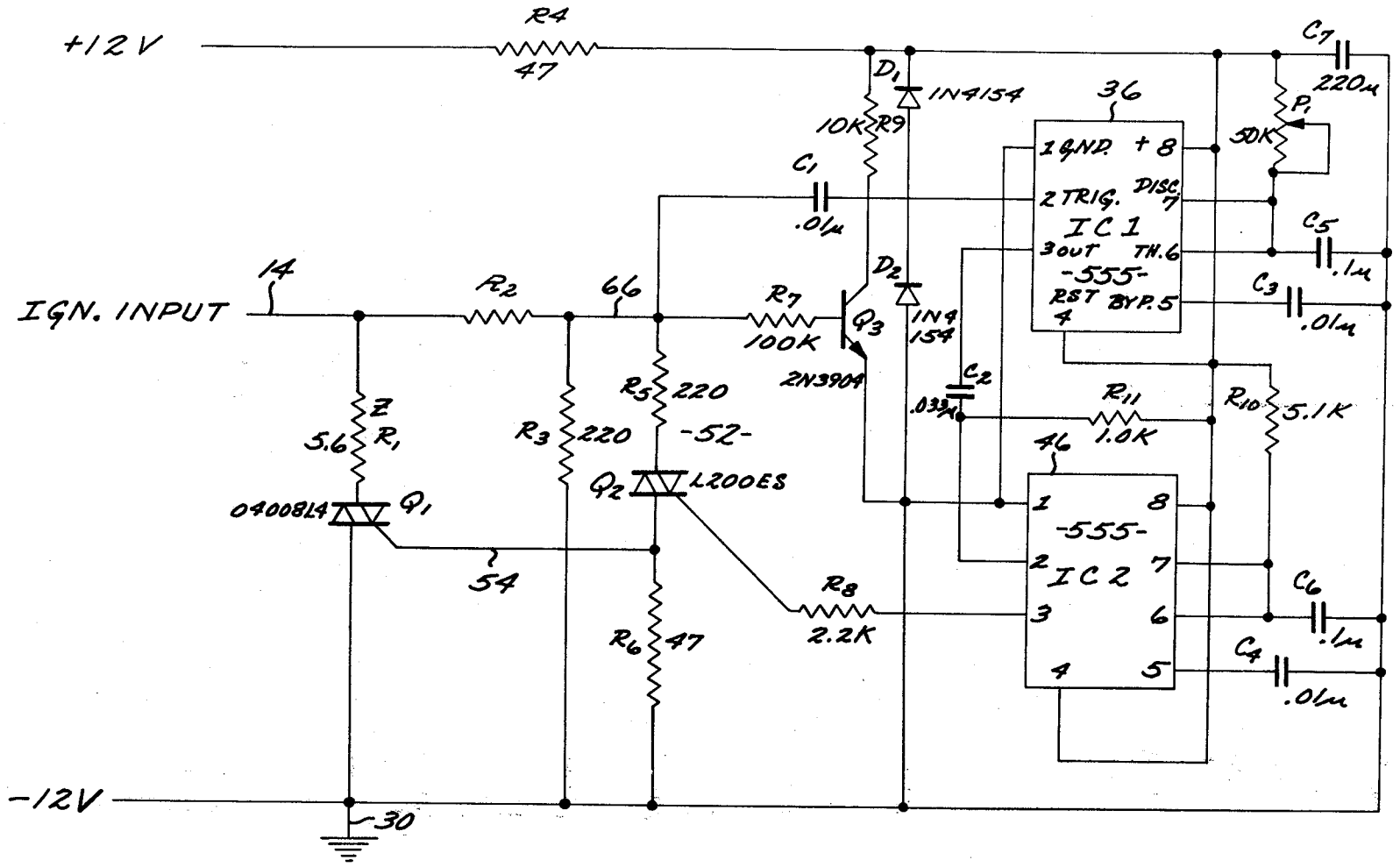
FIG. 3 is an electrical schematic diagram of the rotational speed limiting circuit of the present invention.

FIG. 3 is an electrical schematic diagram of the presently preferred embodiment of the invention and includes an ignition pulse input on line 14 and a ground connection 30. Resistor R1 corresponds to the impedance Z shown in FIG. 1 and Q1 corresponds to the controlled switch 32. Controlled switch Q1 is bidirectional so that both positive and negative going ignition pulses may be inhibited. This results in great versatility in that many commonly used ignition systems use either positive or negative going ignition pulses. The ignition pulse is connected to a voltage divider consisting of resistors R2 and R3 to reduce the relatively high ignition input voltage to a level usable by the electronic circuitry of the remainder of the rpm limiter. The reduced level ignition pulse on output tap line 66 is applied to the trigger input on pin 2 of IC1, the first timer 36 either directly through capacitor C1 if the ignition pulse is negative going, or through an inverting transistor Q3 if it is positive going. The transistor Q3 responses to a positive going ignition pulse and conducts to produce a negative pulse through the bidirectional switch Q2 to charge the capacitor C1 to provide a negative input to pin 2 of the timer ICl. Timer IC1 produces an output waveform shown in FIG. 2B which is capacitively coupled through C2 through the trigger input of IC2, the second timer 46. As the timers require negative going trigger inputs, timer 46 remains quiescent as timer 36 is turned on. The ignition pulse on line 66 is also applied to what will be the delay circuit 52 which includes resistor R5 in series with Q2, another bidirectional controlled switch, and resistor R6, which serves as a gate pulse resistor for generating a gate pulse on line 54 to trigger Q1 under the limiting conditions.

The first timer 36 (IC1) is on for a time period T2, as discussed above, which may be controlled by the potentiometer P1 and when the timer turns off, the negative going signal 44 is capacitively coupled through capacitor C2 to the trigger input of the second timer 46 (IC2). The capacitors C3, C5 and C7 isolate the first timer 36 from D.C. voltage and capacitors C4 and C6 provide D.C. isolation to the second timer 46. The second timer produces the window signal 48 at its output on pin 3 which is connected through a resistor R8 to the gate input of the bidirectional controlled switch Q2. Thus, the switch Q2 is enabled for conduction during the time T3 by means of the window signal 48 from the second timer 46. If an ignition pulse occurs while Q2 is enabled, the ignition pulse will initially rise to a value which permits triggering of the first timer 36 and as the voltage at line 66 increases rapidly, the threshold voltage of the bidirectional controlled switch Q2 will be reached, closing the series resistor circuit and causing a gate pulse to be generated on line 54 which triggers the bidirectional controlled switch Q1. The resistor R1 (Z) is then connected in series with the primary winding to produce a voltage waveform 62, 64 as shown in FIG. 2D.

It can be seen that the time delay between the initial rise of the ignition pulse and the closing of the controlled switch Q1 is very small and independent of the operation of the other circuitry in the rpm limiter. All that is required is that the switch Q2 be enabled during the desired limiting time. The inhibiting circuit then operates substantially independently and very quickly. However, the initial rise prior to reaching the threshold voltage of switch Q2 is quite adequate to trigger the first timer 36.

Thus, the rpm limiter of the present invention provides zero-hysteresis operation and monitors the time period between each successive ignition pulse to determine whether that time period represents an rpm limit. A unique delay circuit is employed to permit an ignition pulse to be inhibited to initially rise to a point where the timing circuits can be triggered but which produces a waveform in the primary circuit in the ignition coil which does not result in the production of a spark. The rpm limiter of the invention can utilize both positive and negative going ignition pulses using bidirectional controlled switches and a novel direct or transistor reversal circuit to provide a single polarity trigger pulse for the timing circuits.

While a particular presented preferred embodiment of the invention has been described in detail, it will be appreciated that numerous modifications may be made in implementing the rpm limiting system of the present invention. Therefore, the invention is not to be limited except by the following claims.

I claim:

1. In an ignition system for an internal combustion system having an ignition coil with primary and secondary windings and a breaker switch connected in the series circuit with the primary winding and a power source, the periodic opening of the breaker switch being synchronous with the speed of the engine and the time period between openings being directly proportional to the rotational speed of the engine, there being an ignition pulse produced across the breaker switch when opened, apparatus for limiting the rotational speed of the engine to a predetermined rate, comprising:

a voltage dividing network with an output tap connected across said breaker switch, first digital timer means connected to said breaker switch and responsive to said ignition pulse to produce a first time signal during a first time period;

a potentiometer connected to said first digital timer means to allow adjustment of the duration of said first time signal, bidirectional trigger means connected to said output tap of said voltage dividing network including a direct connection and a parallel pulse polarity inverting means connected to said first digital timer means;

second digital timer means connected to said first timer means and responsive to the end of said first time signal to produce a second time signal for a second time period of fixed duration;

first bidirectional controlled switch means connnected to said output tap of said voltage dividing network in series with an impedance across said breaker switch, said switch having a gate terminal; and second bidirectional switch means connected in series circuit with a gate resistor across said breaker switch and having a gate terminal connected to receive said second time signal of said second digital timer means, the junction of said gate resistor and said second bidirectional switch means being connected to said gate terminal of said first bidirectional switch means, whereby said second bidirectional switch means serves as a delay means to change the waveform of said ignition pulse when said first bidirectional switch means is conducting.

2. An ignition system according to claim 1 further characterized in that said first and second bidirectional controlled switch means are triacs.

* * * * *